US005233807A

United States Patent [19]

Spera

[11] Patent Number: 5,233,807

[45] Date of Patent: Aug. 10, 1993

[54] MULTI-PURPOSE STRUCTURAL MEMBER FOR CONCRETE FORMWORK

[75] Inventor: Vittorio Spera, St. Leonard, Canada

[73] Assignee: Speral Aluminium Inc., St. Leonard, Canada

[21] Appl. No.: 709,996

[22] Filed: Jun. 4, 1991

[51] Int. Cl.[5] ..... E04C 3/30

[52] U.S. Cl. ..... 52/729; 52/731.1; 52/738

[58] Field of Search ..... 52/729-732, 52/737, 738, 720, 721, 710, 711, 238.1, 243, 243.1, 239

[56] References Cited

U.S. PATENT DOCUMENTS

| | | | |
|---|---|---|---|
| 523,075 | 7/1894 | Krause | 52/732 |
| 3,143,165 | 8/1964 | Lewis et al. | 52/731 |
| 3,327,438 | 6/1967 | Cooper | 52/238.1 |
| 3,797,793 | 3/1974 | Moritz et al. | 248/295 |
| 3,918,223 | 11/1975 | Carlsson | 52/731 |
| 4,033,544 | 7/1977 | Johnston | 249/40 |
| 4,034,957 | 7/1977 | Cody | 52/729 |
| 4,144,690 | 3/1979 | Avery | 52/376 |
| 4,156,999 | 6/1979 | Avery | 52/376 |
| 4,159,604 | 7/1979 | Burrell | 52/376 |
| 4,350,318 | 9/1982 | Gallis | 249/40 |
| 4,422,617 | 12/1983 | Gallis | 249/40 |
| 5,062,369 | 11/1991 | Cobden et al. | 52/729 |
| 5,065,556 | 11/1991 | De Long et al. | 52/239 |

FOREIGN PATENT DOCUMENTS

| | | | |
|---|---|---|---|
| 0022732 | 1/1981 | European Pat. Off. | 52/242 |
| 0333686 | 9/1989 | European Pat. Off. | 52/243.1 |
| 3532507 | 3/1987 | Fed. Rep. of Germany | 52/720 |
| 3942122 | 6/1991 | Fed. Rep. of Germany | 52/239 |
| 2090900 | 7/1982 | United Kingdom . | |

*Primary Examiner*—James L. Ridgill, Jr.
*Attorney, Agent, or Firm*—Wenderoth, Lind & Ponack

[57] ABSTRACT

There is disclosed a structural beam for concrete formwork. The beam has a front flange and a rear flange disposed in a spaced apart and parallel configuration. A first web connects the front and rear flanges. A second web is transversely connected to the first web, so that the two webs are disposed in a substantially cruciform configuration. A pair of attachment channels is each respectively disposed at the terminal ends of the second web, the channels extending the entire longitudinal length of the beam. Each of the channels is open in a direction outwardly of the first web, and each provides an abutment surface which is substantially transversely disposed to the front and rear flanges, of the beam.

4 Claims, 11 Drawing Sheets

MULTI-PURPOSE STRUCTURAL MEMBER FOR CONCRETE FORMWORK

FIELD OF THE INVENTION

The present invention relates generally to the field of concrete forming structures and, more particularly, to a versatile elongate beam for use with such structures.

BACKGROUND OF THE INVENTION

It is well known in concrete forming operations to use metal structural members such as walers and strongbacks in conjunction with sheathing panels which are in contact with the poured concrete during the whole of the curing time thereof. In the case of formwork for concrete walls and columns, the sheathing panels defining the pouring space are generally buttressed by a series of elongate waler members which are disposed in a spaced apart parallel configuration immediately behind the panels. These walers, in turn, are connected to strongback shoring members which are disposed transversely to the walers.

An example of known structural members for the forming of concrete walls is disclosed in U.S. Pat. No. 4,350,318, which issued on Sep. 21, 1982 in the name of Gallis. In the Gallis specification, there is disclosed a concrete wallform system having horizontal joists which immediately back the forming panels and vertical walers or strongback members for stiffening the joists. The strongback member as taught by Gallis consists of a pair of spaced channel beams bolted back to back. A tie rod extends between the channel beams and through the shored forming panel to traverse the pouring gap. Thus, each tie rod has its free ends fixed between the channel beams of two corresponding vertical walers placed on opposite sides of the pouring space.

Gallis more particularly teaches the use of a tie connector plate suitable for U-shaped strongback channel beams which are adapted to be placed back to back. The plate has an aperture at the center thereof for receiving the tie rod, and a hook portion along one of its edges which is adapted to overfit a lip on the flange portion of the channels. At the other edge of the plate, a standard bolt clip is used to fasten the connector plate, all without requiring a tie rod to hold the connector in place at a desired position along the strongback while it is being affixed.

In a similar arrangement disclosed in U.S. Pat. No. 4,033,544, issued on Jul. 5, 1977 in the name of Johnston, the back to back channel members of the strongback each have an outwardly and rearwardly facing T-shaped slot formed in the sidewall of the channel. Two slots, one respectively on each of the adjacent channel members of the strongback, are used to secure a tie plate at each place along the length of the strongback where it is desired to dispose a tie rod extending between the panels.

Yet another example of a two-part strongback member consisting of back to back channels is found in U.K. patent application No. GB 2 090 900 A, published on Jul. 21, 1982 in the name of Mandarla.

All of the foregoing examples in the prior art also disclose the use of a joist or waler member having an inverted top-hat channel at one end thereof for receiving a wooden joist insert in snug frictional engagement. The exposed face of the wooden joist insert so held by the waler is disposed in contact with the rear surfaces of the wooden sheathing panels of the concrete formwork, so that the latter may be easily nailed, screwed or otherwise secured to the wooden joist inserts of any number of supporting walers for the panels. Such types of waler members are disclosed in U.S. Pat. No. 4,156,999, issued on Jun. 5, 1979 in the name of Avery, and in U.S. Pat. No. 4,159,604, issued on Jul. 3, 1979 to one Burrell.

In the case of concrete formwork for pouring floor slabs, it has been known to use the sort of structure known in this art as the flying form. Such forms generally comprise a plurality of trusses arranged in the vertical direction for supporting a number of horizontally disposed transverse beams, for instance, those of the type mentioned hereinabove as having a top-hat configuration for retaining a wooden joist insert therein. An upper deck, usually made from plywood panels, is placed onto the transverse beams and is secured to the wooden inserts thereof by nailing, screwing or the like. Liquid concrete is then poured onto the deck to a desired depth. When the concrete has sufficiently set, the flying form may be removed as an integral unit without appreciable dismantling of its component parts and, if necessary, "flown" or hoisted above the concrete slab it previously supported to thereby serve in the pouring of yet another slab of concrete. A typical known flying form structure is disclosed in U.S. Pat. No. 4,144,690 in the name of Avery, which patent issued on Mar. 20, 1979.

A further example in the prior art of a joist-like structural member for concrete formwork is provided in U.S. Pat. No. 4,034,957, which was issued on Jul. 12, 1977 in the name of Cody. This reference discloses a multi-purpose extruded member which is generally in the shape of an I-beam. The beam according to Cody is provided along the longitudinal edge regions thereof with laterally extending flanges joined together by an intermediate web. Each such flange consists of two coplanar parts which are separated by a central channel adapted to receive and retain either a wooden nailing strip or the head of a bolt. Cody teaches that his structural member is capable of being used in a variety of different structural configurations, for instance, either as a waler member or strongback for wallforms, or alternatively, as a supporting horizontal stringer in connection with floor slab formwork.

It is an object of the present invention to provide a novel multi-purpose structural member for concrete formwork which, for example, may serve either as a strongback for panel members used in the pouring of concrete columns and walls, or as a structural beam in the trusses of a flying form.

It is another object of the present invention to provide a structural member for concrete formwork structures in a configuration which allows for a number of different attachment methods and positions for the various structural components of such structures, thereby facilitating the connection of the member to the walers of a concrete sheathing panel or to the chord members of a truss.

It is a further object of the present invention to provide a structural member which may be adapted to be used as a paired strongback assembly for concrete sheathing panels where, for instance, two structural members are joined together in a vertical truss arrangement by a plurality of chords, the truss arrangement extending generally perpendicular to the panels.

These and other objects of the invention will be apparent from the detailed description of preferred embodiments thereof which is set out hereinbelow.

SUMMARY OF THE INVENTION

According to a broad aspect of the present invention, there is provided:

An elongate beam for concrete formwork, the beam comprising:

a flat front flange and a flat rear flange, said flanges being disposed in a spaced apart and substantially parallel configuration, each flange having side edges at terminal ends thereof which extend longitudinally the entire length of said beam;

a first intermediate web connecting said front and rear flanges and having two sides extending longitudinally the entire length of said beam;

a second intermediate web transversely connected to said first web, said first and second webs being disposed in a substantially cruciform configuration;

a pair of attachment means, said attachment means constituting means for attaching said beam to a structural member, each of the attachment means being respectively disposed at terminal ends of said second web, said means each having a substantially T-shaped channel extending the entire longitudinal length of said beam, each of said channels being open in a direction outwardly and substantially transverse of said first web, the attachment means each further having a planar abutment surface extending longitudinally of said beam and being disposed substantially transversely to said front and rear flanges, each channel of each attachment means having a generally rectangular cross-section and being defined by an inner wall portion connected transversely to said terminal end of said second web and by two sidewall portions which respectively extend from said inner wall portion at the terminal ends thereof, free ends of said sidewall portions each having coplanar flanges defining the said abutment surface of the attachment means, said coplanar flanges extending inwardly of the channel to thereby define said substantially T-shaped slots;

a said side edge of the front flange, a said side edge of the rear flange and a said abutment surface respectively located to each side of said first web being substantially coplanar.

Given that the front and rear flanges of the structural member are be provided with side edges which are substantially coplanar with said abutment surfaces of the attachment means, the attachment means may conveniently be used to retain one leg of an L-shaped bracket for affixing the other leg thereof to a waler member. The leg of the bracket adjacent the attachment means can be made to securely abut against one coplanar side edge of the front flange of the structural member and the abutment surfaces of the attachment means to which the leg is affixed. Moreover, the bracket may be disposed such that the said other leg, together with the front flange of the member, provides a continuous abutment surface for the waler. Where the structural member is to be used in a set of paired strongbacks disposed perpendicular to the sheathing panels which they shore, the side edges of the front and rear flanges of the strongbacks, being coplanar to the abutment surfaces of the channel means, provide additional structural support to the chord members which interconnect the two strongbacks of the pair. This very same advantage is obtained when any one of the described preferred embodiments is used as the structural member of a truss in a flying form.

The invention is especially suited for use as a strongback for the shoring of metallic concrete forming panels, for instance, panels of the type described in my copending U.S. application Ser. No. 07/456,964, filed on Dec. 26, 1989, and in my copending PCT application Ser. No. PCT/CA90/00429, filed on Dec. 3, 1990.

In a second embodiment of the invention, at least one of the front and rear flanges of the structural member provides a second pair of attachment means. Each of these attachment means presents a channel extending the entire longitudinal length of the member, with each of the channels being open in substantially the same direction as the attachment means disposed at the terminal ends of the second web. The said second pair of attachment means further provides an abutment surface which is substantially coplanar with an abutment surface of the attachment means of the second web.

In the structural member according to the second embodiment thereof described above, each channel of the second pair of attachment means may be generally of rectangular cross-section. The attachment means may be further defined by an inner wall portion connected substantially perpendicularly to the flange of the member, and by a side wall portion which extends from the inner wall portion at the terminal end thereof in a direction substantially parallel to the flange, with the free ends of the side wall portion and of said flange each being provided with coplanar flanges defining the abutment surface of the second attachment means. Moreover, the structural member according to its second embodiment may be provided with the coplanar flanges, defining the abutment surface of the second abutment means, extending inwardly of the channel to thereby provide a substantially T-shaped slot.

The second embodiment of the present invention is well suited for use as a structural member in a truss of a flying form. By disposing two such structural members in a spaced parallel and vertical arrangement, the attachment means of each member will permit any number of connecting chords to be affixed to the two members to form a truss. Since a first and a second pair of attachment means are provided in the structural member according to the second embodiment of the invention, each chord may be secured at a desired position along the horizontal length of each structural member by employing up to two bolts or other like fasteners at each end of the chord. Thus, the present invention permits the structural member to be used as a versatile truss beam, allowing for a number of different chord geometries to be employed with the same member, and providing a secure bolting arrangement at the ends of each chord member.

As is the case for the first embodiment of the invention, in the structural member according to its second embodiment, the side edges of the flange which does not provide the second pair of attachment means, the abutment surfaces of the attachment means of the second web, and the abutment surfaces of the second pair of attachment means, are substantially coplanar.

In a third embodiment of the present invention, the structural member is composed of two parts, each part having a generally E-shaped cross-section, the parts being arranged back to back in a spaced apart configuration to permit a tie rod or the like to be deposed therebetween. In this way, the third embodiment is especially adapted to be used with conventional concrete formwork, employing plywood sheathing panels which require a plurality of tie rods in order to oppose the outward pressure of the poured liquid concrete against the panels.

BRIEF DESCRIPTION OF THE DRAWINGS

For purposes of illustration, but not of limitation, embodiments of the invention will be described hereinbelow with reference to the following drawings, in which.

DETAILED DESCRIPTION OF PREFERRED EMBODIMENTS

Figure 1:
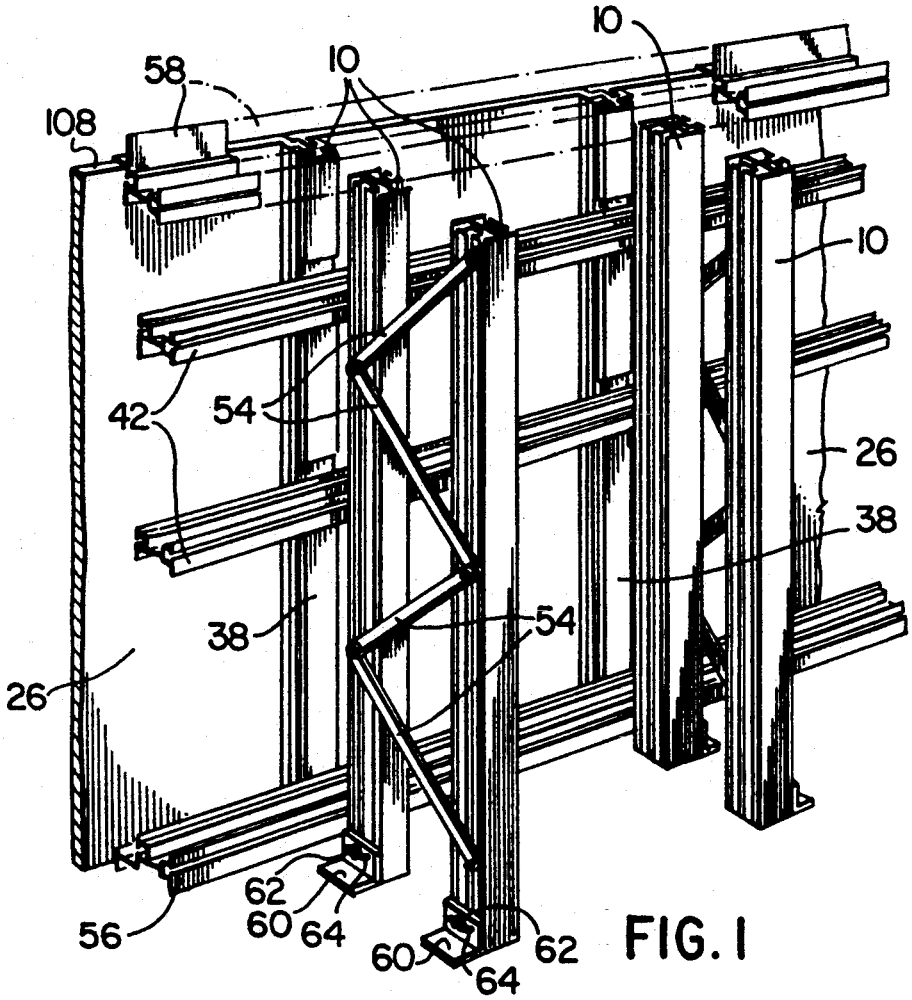
FIG. 1 is a partial perspective view of one side of a concrete formwork installation for pouring a wall section, showing metal sheathing panels, a bottom template member, a top splicing member, intermediate walers and a paired strongback truss arrangement according to a first embodiment of the present invention.
Figure 2:
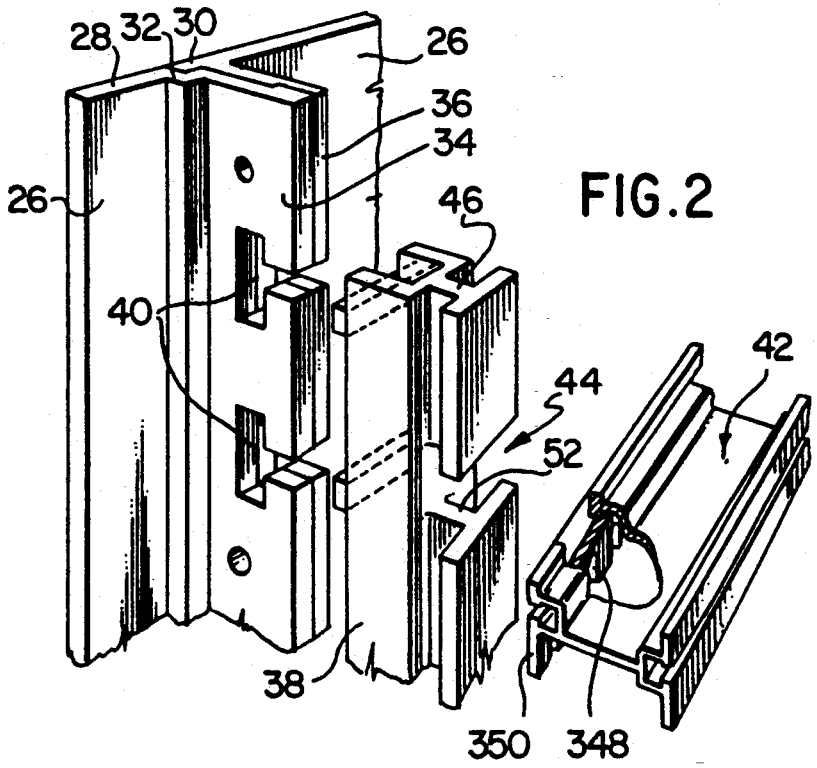
FIG. 2 is a detailed partial perspective and exploded view of the formwork of FIG. 1, showing the attachment of a waler member to the locking member for two adjacent metal sheathing panels.

In use, the structural member 10 according to a first embodiment of the present invention is employed as a strongback member in a paired configuration for shoring concrete sheathing panels of the type shown in FIGS. 1 and 2. The sheathing panels 26 are preferably elongate panels adapted for connection in an edge-to-edge upstanding configuration, and may be made from aluminum alloy. Each of the panels 26 has, adjacent the front pouring face 28 thereof, a protruding tongue portion 30 for engagement with a corresponding stepped surface 32 of an immediately adjacent panel (FIG. 2). Each of the panels also provides two transverse mating flange members 34,36. The panel members 26 are secured together by way of locking key members 38, each of these members being received in drop-fit engagement with corresponding communicating slots 40 provided in the flanges 34,36 of the panels.

The panel members and locking key members shown in FIGS. 1 and 2 have been disclosed in my copending U.S. patent application Ser. No. 07/456,964, filed on Dec. 26, 1989, and in my copending international application Ser. No. PCT/CA90/00429, filed on Dec. 3, 1990, which are both incorporated herein by reference. These two copending applications claim priority from my corresponding Canadian application Ser. No. 2,006,575, filed on Dec. 22, 1989. Of course, those skilled in this art will readily appreciate that the present invention may be adapted for use with a number of different concrete forming panels, structures and methods. For instance, the present invention may be employed with conventional wood sheathing panels as well as metal panel members other than those described and illustrated herein.

A plurality of horizontally disposed waler members 42 is provided immediately backing the locking key members 38 of the formwork arrangement. Where the locking key member is provided as a continuous member extending substantially the entire height of the panels as shown in the drawings, the walers 42 may be received in slots 44 disposed on the rear of the key members. If, on the other hand, the key members are provided in shorter lengths, so that a number of them are required in a spaced vertical arrangement for connecting two adjacent panels 26, the walers may be made to engage the upper portions of each of the locking members, as at 46. For this purpose, the walers may be provided with a number of spaced apart vertical slots 348 along the front abutment surface 350 thereof to engage with a corresponding web portion 52 of the locking key member 38 in either of the ways as aforesaid. Further details of the waler members 42 are described hereinbelow.

Each of the waler members 42 is connected in turn to the paired strongbacks 10 in the manner discussed at greater length in what follows. Each pair of strongbacks is disposed transversely to the sheathing panels 26 as shown in FIG. 1. The strongbacks 10 of each strongback pair are connected the one to the other by means of a plurality of chords 54 to form a truss arrangement.

In addition to the walers 42, the formwork assembly will generally comprise a bottom template member 56 on which the panels 26 are seated. Moreover, a top splicing member 58 may also be employed with the formwork as shown in FIG. 1, and this member may serve as a splash guard placed over the leading top edges of the panels, or alternatively, as a means of splicing or supporting a vertical extension of the panels. The splash guard feature of member 58 reduces the likelihood that liquid concrete will spill outside of the pouring gap during pouring and harden at the mating surfaces of the various components of the formwork, thereby making dismantling and reuse of the components difficult. More details of the features of the bottom template member 56 and top splicing member 58 are provided below.

Figure 3:
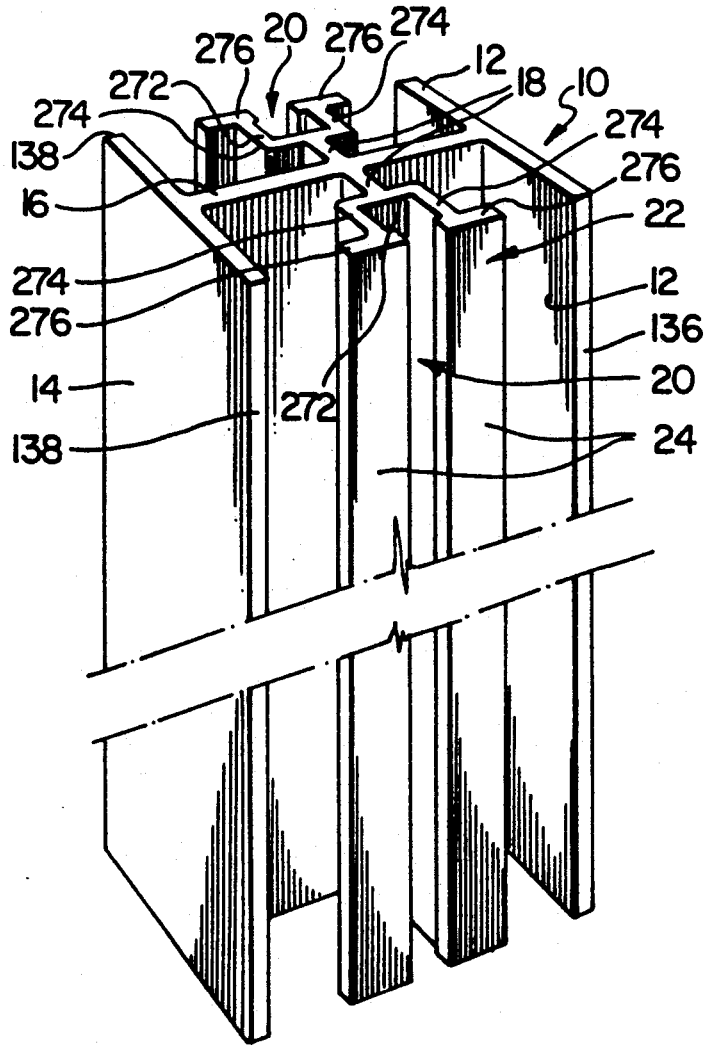
FIG. 3 is a perspective view of the strongback member shown in FIG. 1, which provides a pair of channel-like attachment means.

The structural member 10 according to the first embodiment of the present invention is best shown in FIG. 3. The member 10 consists of an elongate beam which is preferably formed from extruded metal stock such as aluminum alloy. The beam has a front flange 12 and a rear flange 14, which are spaced apart substantially parallel to each other and are connected together by a first intermediate web 16. A second intermediate web 18 is transversely connected to the first web 16, so that the first and second webs are disposed in a substantially cruciform configuration. Two attachment means 22, each being respectively disposed at the terminal ends of the second web 18, present a channel 20 extending the entire longitudinal length of the member 10. Each of these channels 20 are open in a direction outwardly of the first intermediate web 16, and each further provides an abutment surface 24 which is substantially transversely disposed to the front and rear flanges 12,14.

The ends of the chords 54 for the strongback pairs are secured to the strongbacks 10 at the longitudinal channels 20 running the entire lengths thereof, which can be used to retain the heads of connecting bolts or the like, the connection being explained in more detail below.

Each channel 20 of the attachment means 22 is generally of rectangular cross section and is defined by an inner wall portion 272 connected to the free terminal ends of the second web 18 and by two side wall portions 274 which respectively extend from the inner wall portion 272 at the terminal ends thereof. The free ends of the side wall portions 274 each provide coplanar flanges 276 which define the abutment surfaces 24 of the attachment means 22. The coplanar flanges 276 extend inwardly of the channel 20 to thereby provide a substantially T-shaped slot capable of retaining the head of a bolt while allowing the shank thereof to extend outwardly from the channel.

Each of the strongbacks 10 may also be provided with levelling shoes 60, consisting of angles having a horizontal portion in contact with the floor surface and a vertical portion which abuts against and connects to the bottom sides of the strongbacks. Again, this connection is made by means of the longitudinal channels 20 of the strongbacks, which retain the heads of the bolts 62 for securing the shoes 60 to the strongbacks. Curved slots 64 are provided on the vertical abutting portions of the shoes to assist in positioning each shoe so that each of its associated strongbacks may be levelled. If desired, a single shoe for each strongback pair may suffice for levelling purposes.

Figure 4:
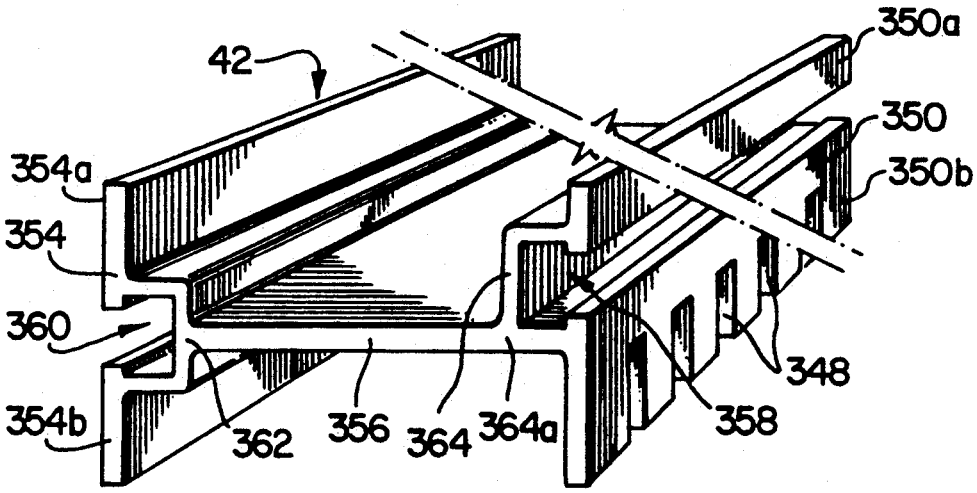
FIG. 4 is a perspective view of the waler member of FIGS. 1 and 2.

Turning now to the details of the construction of the waler members 42 as best shown in FIG. 4, each waler provides a front abutment surface 350 and a rear abutment surface 354, which front and rear surfaces are generally parallel and connected the one to the other by an intermediate web 356. Waler members 42 may advantageously be manufactured from aluminum alloy extrusions, if desired. The front abutment surface 350 is divided into an upper portion **350*a* and a lower portion 350*b* in which are disposed a number of spaced apart vertical slots 348 as previously described. The upper and lower portions 350*a* and 350*b* are separated by a longitudinal channel 358 in the form of the substantially T-shaped slot. The channel 358 runs the entire length of the waler 42. Likewise, the rear abutment surface 354 of the waler 42 is also divided into upper and lower portions 354*a* and 354*b*, separated by a longitudinal channel 360 having a similar construction to the channel 358. In order to accommodate the spaced apart vertical slots 348 in the front abutment surface 350 of the waler member 42, the lower portion 350*b* may be made larger in height than the upper portion 350*a* thereof. This may be accomplished, for instance, by offsetting the position of the channel 358 with respect to the intermediate web 356 of the waler, as shown in FIG. 4. Thus, whereas the rear wall portion 362 of channel 360 is centered about the web 356, the rear wall 364 of channel 358 connects to web 356 at the lower extremity 364*a*** thereof.

The channels 358 and 360 of the waler member 42 may serve for a number of attachment purposes. For instance, as discussed below, the rear channel 360 may be used to retain the head of a bolt or the like for attachment to a bracket which in turn is connected to the strongback member 10. As for the front channel 358, it may serve to attach brackets or like attachment means for connecting a number of horizontally adjacent and transverse walers disposed around the periphery of a rectangular-shaped panel configuration for pouring a wall or column. In this manner, the horizontally adjacent walers along each face of a waler column may be connected the one to the other for greater structural stability.

Figure 5:
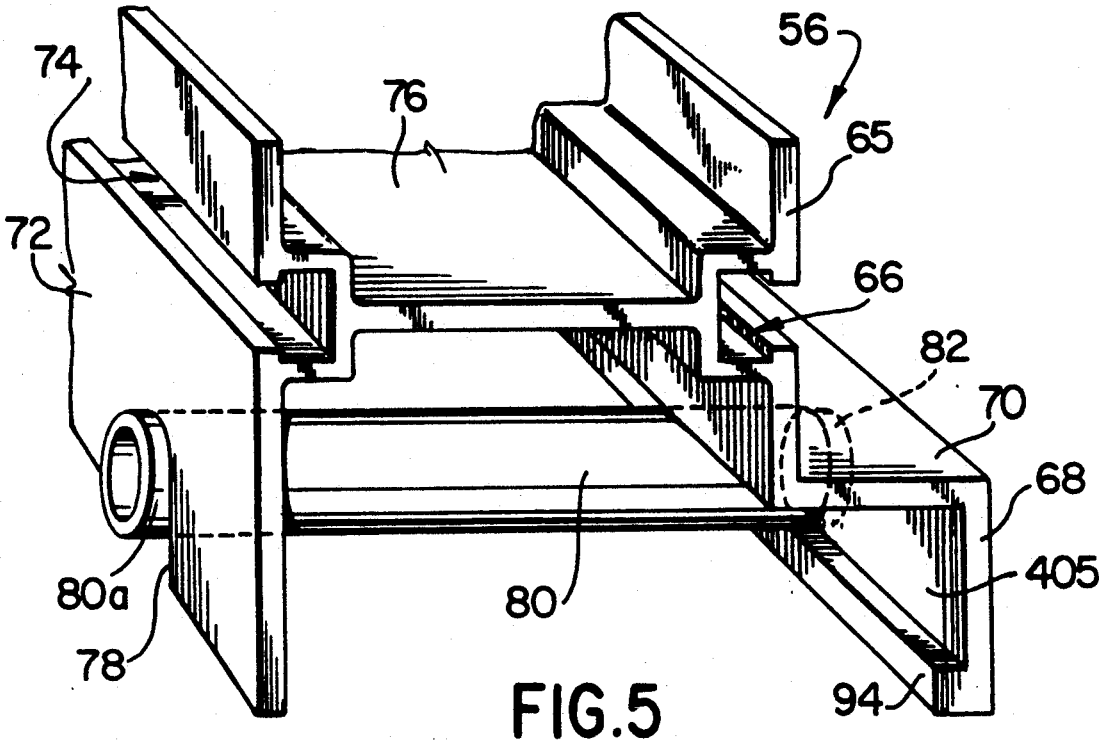
FIG. 5 is a perspective view of the bottom template member of FIG. 1, showing a sleeve for use therewith through which a bottom tie rod for the panels is received.

FIG. 5 shows the details of construction of a bottom template member 56. Like the waler member 42, the template member may be formed from an aluminum alloy extrusion. The template member has a front portion characterized by a first vertical abutment surface 65 presenting an open and substantially T-shaped channel 66. A second vertical abutment surface 68 is provided along the lower front portion of the template, and the two abutment surfaces 65 and 68 are separated by a horizontal stepped surface 70 on which the sheathing panels 26 are placed. The template member 56 also has a rear abutment surface 72 which, like the front abutment surface 65, presents a rear open and T-shaped channel 74. The front abutment surface 65 of member 56 and the rear abutment surface 72 thereof are interconnected by means of an intermediate web 76.

The longitudinal channels 66 and 74 of the template member 56, as is the case for the similar channels 358, 360 of the waler member 42, are adapted for retaining bolt heads or other fastening means to permit the connection of the template member to other components of the formwork. For instance, the rear channel 74 of the template member 56 may serve to hold a connecting bracket for affixing the bottom template member 56 to a strongback 10 at the longitudinal channels 20 thereof. As for the front channel 66 of the template member, this may be used in the manner of the channel 358 of the waler 42 in order to join horizontally adjacent template members 56 the one to the other.

Figure 14:
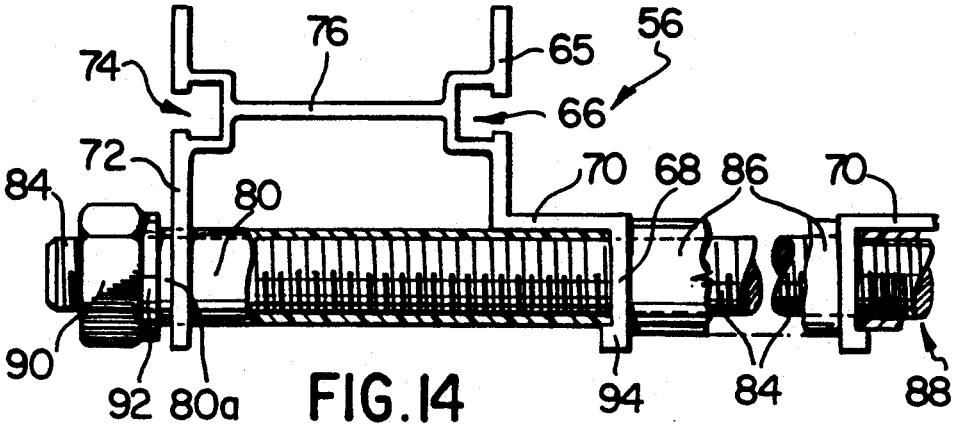
FIG. 14 is a detailed partial side view of two bottom template members according to FIG. 5, showing a bottom tie rod disposed therethrough.

The rear abutment surface 72 of the template member 56 provides a plurality of vertical slots 78 which are used to receive a guide tube 80 through which a bottom tie may be disposed. The lower vertical abutment surface 68 of the member 56 provides a corresponding aperture 82 therein so that the tie rod may extend into the pouring gap between the sheathing panels 26. The template member 56 also provides a ledge portion 94 adjacent the front vertical abutment surface 68 for assisting in retaining guide tube 80 in place. As best shown in FIG. 14, the bottom tie 84 is introduced through guide tube 80 and the front vertical abutment surface 68, whereupon the tie rod 84 enters a protective sleeve 86 disposed in the pouring gap. The tie rod 84 is of sufficient length to exit the pouring gap through an opposing bottom template member 88 shown only partially in FIG. 14. On each of the rear vertical abutment surfaces 72 of the template member 56 at either end of the tie rod 84, a nut 90 and washer 92 are used to secure the rod in place by tightening the nut and washer 90,92 against a protruding portion 80*a* of the guide rod 80. In this way, the rod is not affixed directly against the rear vertical abutment surface 72, thereby avoiding the possibility of permanently deforming or otherwise weakening that portion of the template member 56 adjacent the slots 78.

Those skilled in this art will appreciate that guide tube 80 of the template member may be dispensed with and tie rod 84 may be affixed to the inner surface 405 of the vertical abutment surface 68. In this situation, the vertical slots 78 on the rear abutment surface 72 of the template member 56 will have to be made sufficiently large enough to permit access of a workperson's hands to the inner surface 405 of the vertical abutment surface 405 of the member so that the rod may be affixed thereto.

Figure 6:
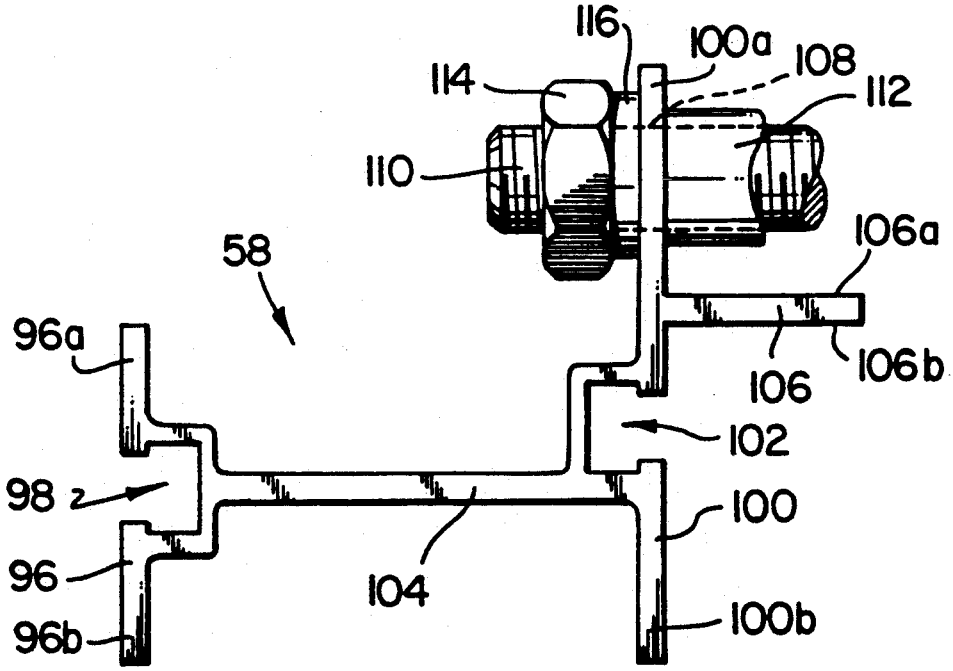
FIG. 6 is a side elevational view of the top splicing member of FIG. 1, with a top tie rod being held thereby.

Turning now to FIG. 6, the details of the splicing member 58 include a rear vertical abutment surface 96 comprised of upper and lower sections 96*a* and 96*b*. As is the case for waler member 42 and template member 56, the splicing member 58 lends itself to manufacture from aluminum alloy extrusions. The sections 96*a* and 96*b* are separated by a longitudinal channel 98, having a substantially T-shaped profile and extending the entire length of the splicing member 58. The member also provides a top vertical abutment surface 100*a* and a lower vertical abutment surface 100*b* which are likewise separated by a channel 102 similar in construction to channel 98 of the splicing member. The front and rear vertical abutment surfaces 100,96 are connected by an intermediate web 104. The features which distinguish the splicing member 58 from the waler member 42 are that the top vertical abutment surface 100*a* is larger in height than its counterpart 350*a* in the waler member 42, and that a horizontal ledge portion 106 is provided adjacent the lower extremity of the abutment surface 100*a* in the splicing member.

Figure 13:
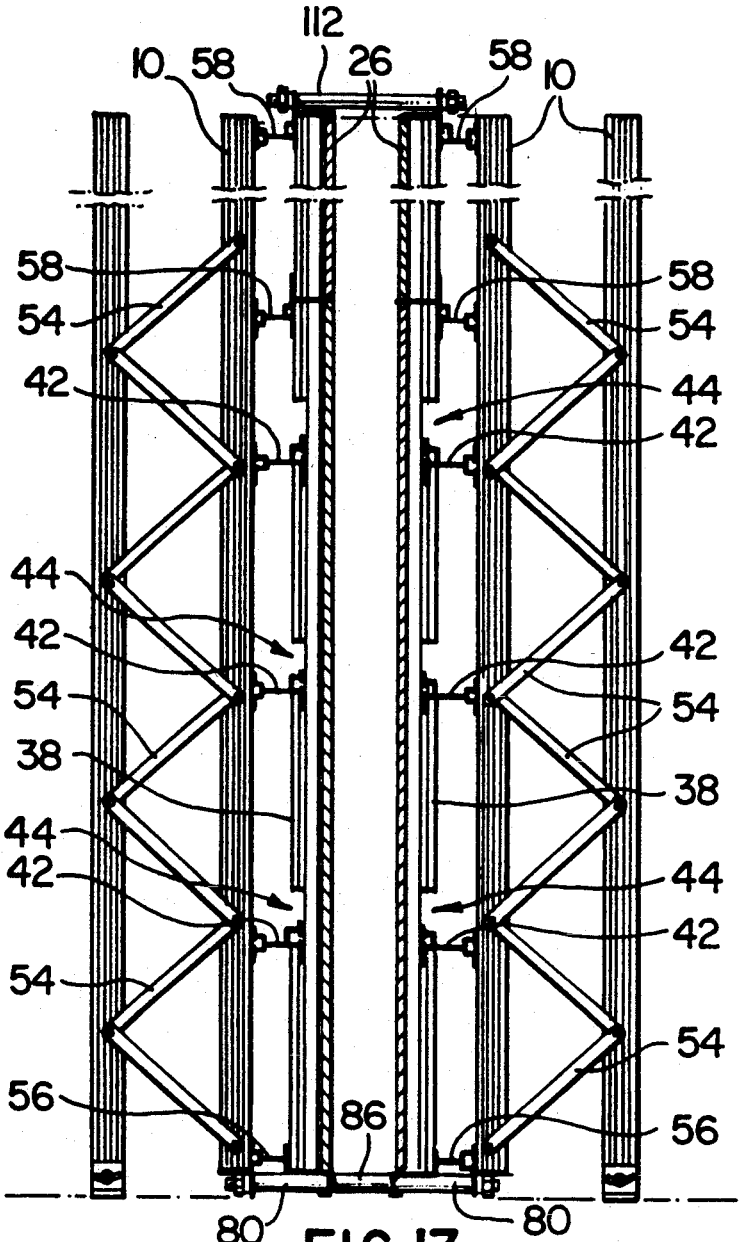
FIG. 13 is a side cross-sectional view of a concrete formwork installation, showing the paired strongback arrangement of FIG. 1 and also showing the use of the splicing member of FIG. 6 in order to mount two sheathing panels one atop the other.

The lower surface 106*b* of the ledge portion 106 is placed atop the upper leading edge 108 of the sheathing panels 26, as shown in FIG. 1. This permits the splicing member 58 to be used as a splash guard as was previously discussed. Where the splicing member is to support a second set of panels to be placed atop the first set of panels 26 for pouring taller wall or column sections, the second set of panels 26 may be supported by the upper surface 106*a* of the ledge portion 106. This is best shown in FIG. 13.

Where splicing member 58 is used as a splash guard and not in order to support a second set of panels as described above, the upper vertical abutment surface 100*a* thereof may have a plurality of apertures 108 therethrough for accepting an upper tie rod 110 to span the pouring gap. Although the rod 110 is not intended to be embedded in the concrete once cured, it is received through a protective sleeve 112 so that the rod will not come into contact with wet concrete during pouring. This enables the rod 110 to be withdrawn from protective sleeve 112 and subsequently reused in another pouring operation. The rod 110 is affixed to the upper vertical abutment surface 100*a* by means of a standard nut 114 and washer 116.

Figure 7:
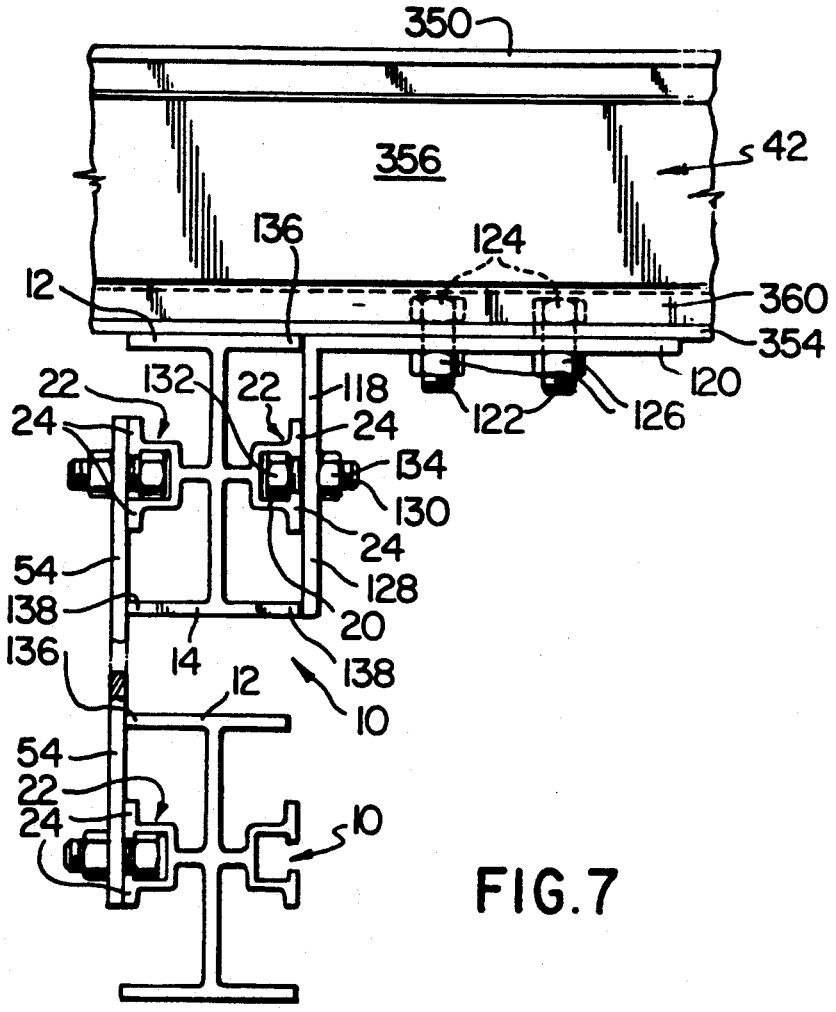
FIG. 7 is a top plan view of the waler member according to FIG. 4, attached to the paired strongback assembly as shown in FIG. 1 by means of an angle bracket.

FIGS. 7 to 12 describe a number of means for connecting the strongback members 10 to the rear abutment surfaces 54 of the waler members 42. Referring first to FIG. 7, a generally L-shaped bracket 118 has one of its legs 120 connected by a pair of bolts 122 to the waler member 42. The heads 124 of bolts 122 are received in slidable engagement with the T-shaped channel 60 of the member 42. The T-shaped cross section of channel 60 retains the heads of bolts 122 while allowing the shanks thereof to protrude rearwardly through leg 120 of bracket 118. A pair of nuts 126 and washers (not shown) are used to secure the arrangement. As for the second leg 128 of bracket 118, it is affixed to channel member 10 by means of a bolt 130 whose head 132 is slidably retained in one of the channels 20 of member 10 in an analogous manner to the bolts 122 in channel 360 of the waler 42. A single nut 134 and washer (not shown) are used to secure the arrangement.

As shown in FIG. 7, the fact that the respective side edges 136,138 of the front and rear flanges 12,14 are substantially coplanar with the abutment surfaces 24 of the attachment means 22 results in a secure and flush engagement of leg 128 of bracket 118 against the strongback member 10. The same advantage is obtained in relation to the chord members 54 which are able to firmly seat against the abutment surfaces 24 of the attachment means 22 as well as the side edges 136,138 of front and rear flanges 12,14 of the strongback member 10. Moreover, the length of leg 128 is such that the other leg 120 of the bracket provides a continuous abutment surface for waler 42 together with front flange 12 of member 10. By using channel-like attachment means 22 in the strongback member 10 and in conjunction with a similar channel 360 provided along the entire longitudinal length of the waler member 42, the strongback member 10 and waler member 42 may be used in a variety of configurations and positions to suit the formwork needs at hand. The same means of connection may be employed for affixing the bottom waler 56 or the splicing waler 58 to the strongbacks 10 as was described for the waler member 42 above.

FIG. 7 also shows the details of how the chord members 54 are used to connect two strongbacks 10 in a paired configuration. The chords 54 are affixed at each end thereof to the strongback members 10 by means of the channel-like attachment means 22 using the same nut and bolt arrangement described above for affixing bracket 118. Once again, the channel-like nature of attachment means 22 allows for a measure of versatility in affixing the chord members in a desired geometry. Although the strongback members 10 have been described as being utilized in a paired configuration, those skilled in this art will appreciate that other configurations may be selected. For instance, the strongbacks may alternate along a sheathing panel wall section from a paired strongback configuration at one position, to a single strongback in the next adjacent position, and then to another paired strongback assembly next adjacent the single strongback. Of course, single strongbacks 10 may be used throughout a formwork structure, in which case the strongbacks will be coupled to known means of shoring. The precise placement and geometry of the strongbacks in a particular formwork structure will largely be dictated by loading conditions and safety factors, as will be known to those skilled in the art.

Figure 8:
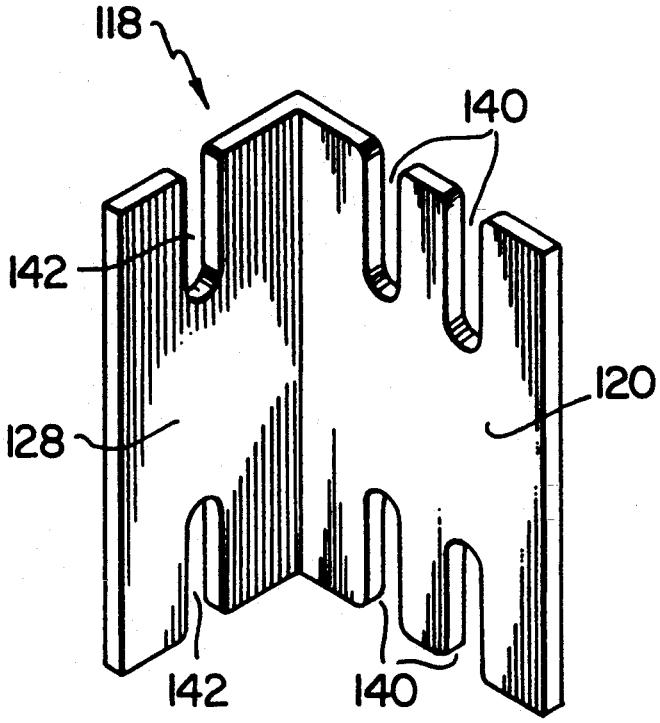
FIG. 8 is a perspective view of a first angle bracket suitable for use with the arrangement as shown in FIG. 7.

FIG. 8 shows the details of the bracket 118 for affixing the waler member 42 to strongback 10. One leg 120 of the bracket is provided with paired upper and lower slots 140 through which the shanks of bolts 122 are disposed. Likewise, for bolts 130, single upper and lower slots 142 are provided on leg 128 of the bracket 118. By having a symmetrical top to bottom configuration of bracket 118, the very same bracket may be employed either to the left or right of a strongback 10 in order to affix it to the channel member 42.

Figure 9:
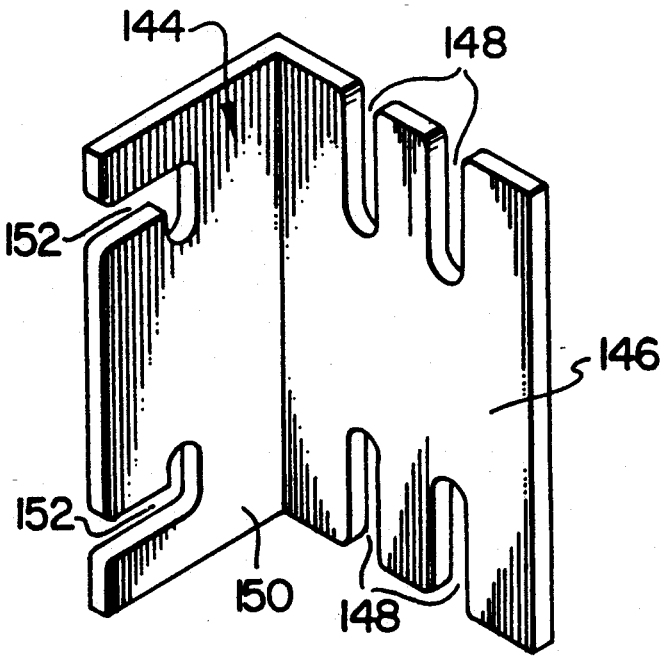
FIG. 9 is a perspective view of a second angle bracket suitable for use with the arrangement as shown in FIG. 7.
Figure 10:
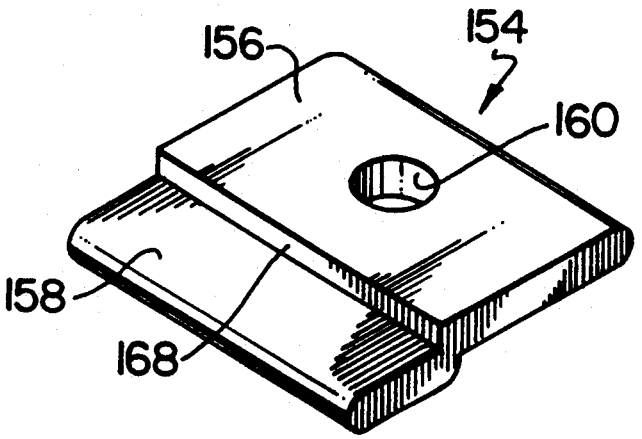
FIG. 10 is a perspective view of a clip member for attaching the waler member of FIG. 4 to the strongback member as shown in FIG. 3, as an alternative to the first and second angle brackets of FIGS. 8 and 9.

An alternative bracket member 144 is shown in FIG. 9. The first leg 146 of the bracket provides, like bracket 118, upper and lower paired slots 148. However, the second leg 150 of bracket 44 is provided with L-shaped upper and lower single slots 152 to provide a convenient drop-down engagement of bracket 144 with bolt 130 of strongback member 10.

Figure 11:
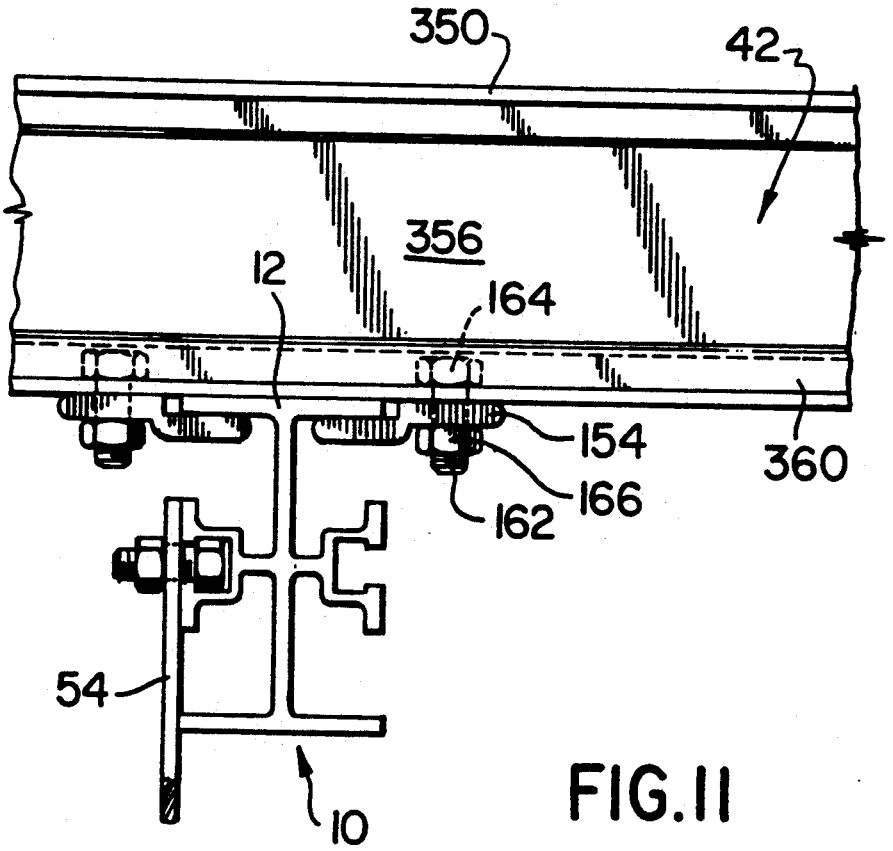
FIG. 11 is a top plan view showing the use of two clip members according to FIG. 10 to secure the waler member to the strongback.

As a further alternative to the use of L-shaped brackets 118 or 144, a clip member 154 (FIG. 10) may be used to affix waler member 42 to a strongback 10, as shown in FIG. 11. The clip member is composed of two stepped surfaces 156, 158, the surface 156 having an aperture 160 therein through which bolt 162 is received. As was previously discussed, the head 164 of bolt 162 is retained by the substantially T-shaped channel 360 of waler member 42. By tightening nut 166 of bolt 162 to secure the clip member 154 to waler member 42, the surface 158 of the clip member is urged against the rear portion of front flange 12 of the strongback member 10. A washer (not shown) may be disposed on bolt 162 between nut 166 and the surface 156 of the clip member 154. The stepped portion 168 of clip 154 is preferably provided in a dimension which is slightly less than the width of flange 12 of member 10, so that the flange 12 is held by the clip member 154 against waler member 42 in a secure and resilient frictional engagement. When using the clip member 154 to secure the walers 42 to the strongbacks 10, it is preferable to use a clip member on either side of flange 12 so as to prevent any lateral movement of the strongback 10. Of course, the clip member 154 may also be used to affix the bottom template members 56 and the top splicing members 58 to the strongbacks 10 in an analogous manner.

Figure 12:
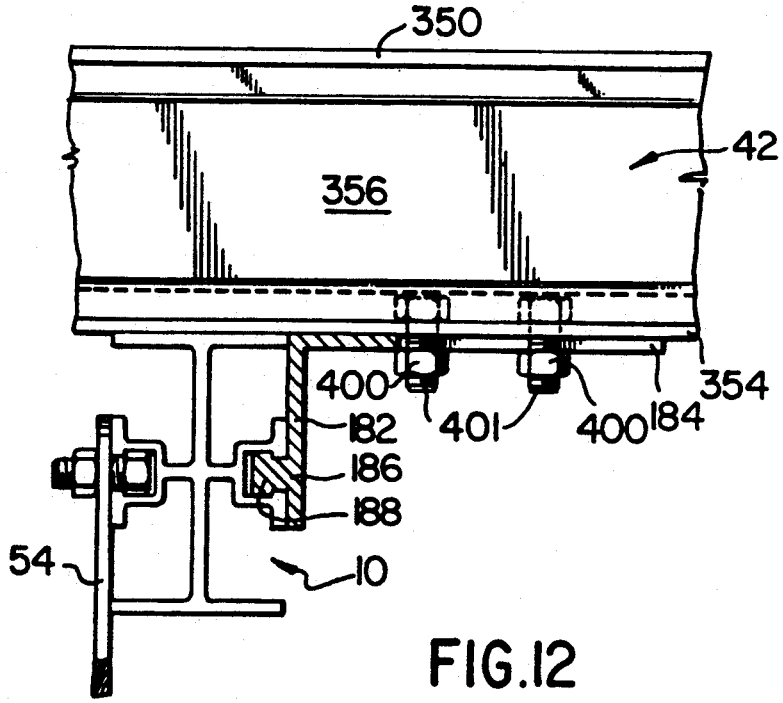
FIG. 12, shown on the same sheet of drawings as FIG. 7, is a top plan view of the waler member according to FIG. 4, attached to the paired strongback assembly as shown in FIG. 1 by means of an angle bracket having a T-shaped portion received in the corresponding channel-like attachment means of the strongback.

FIG. 12 shows another angle bracket 182 for connecting waler member 42 to a strongback member 10. The bracket 182 has a front leg 184 which is attached in the same manner as the respective legs 120,146 of brackets 118 and 144 respectively shown in FIGS. 8 and 9. However, the other leg 186 of bracket 182 is provided with a substantially T-shaped extension 188 which is adapted for slidable intimate engagement with one of the attachment means 22 of the strongback member 10. This allows the bracket 182 to be connected to the strongback member 10 without the use of a nut, bolt and washer arrangement as was described for the bracket-type attachments illustrated in FIGS. 7 to 9. Bracket 182 may also serve to affix bottom template members 56 and top splicing members 58 to the strongbacks 10.

The length of the leg 186 of bracket 182 may be made such that the front leg 184 thereof provides a slight clearance between it and the abutment surface 354 of waler member 42 prior to tightening the nuts 400 of bolts 401. When the nuts 400 are tightened to secure the bracket 182, the leg 184 will be urged into intimate contact with the abutment surface 354, thereby bringing the T-shaped extension 188 of leg 186 of the bracket into resilient and secure contact with the corresponding mating surfaces of the attachment means 22.

Figure 15:
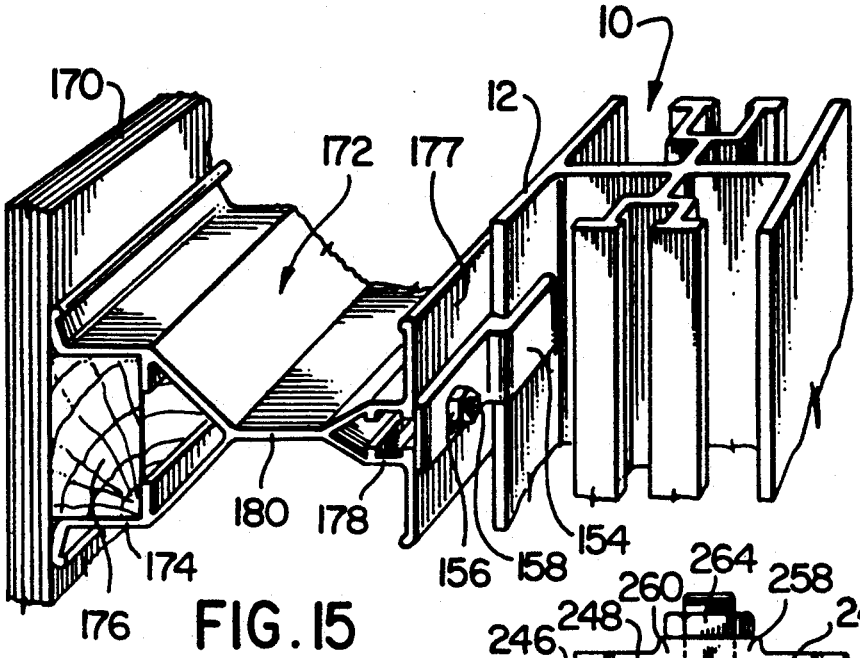
FIG. 15 is a typical wooden sheathing panel installation, showing the use of the strongback member of FIG. 3 with a waler adapted to receive a wooden joist to which the panel is secured.

Turning now to FIG. 15, a typical arrangement is shown whereby a wooden concrete sheathing panel 170 is affixed to the strongback member 10 by means of a joist member 172. The joist member 172 has an inverted top-hat portion 174 which receives, in snug frictional engagement, a wooden insert 176 onto which the panel 170 may be nailed, screwed or otherwise affixed. At the end of the joist member 172 adjacent to the strongback member 10, a rear abutment surface 177 is provided for contacting the front flange portion 12 of the strongback member 10. Through the abutment surface 177, there is provided a bolt retaining channel 178 to permit an attachment member such as clip member 154 to be affixed to the joist member 172 by a nut and bolt 156,158. A washer (not shown) may be disposed on bolt 158 between nut 156 and the abutment surface 177 of the joist. As previously explained, the clip member 154 urges the flange 12 of strongback member 10 against the abutment surface 177 of the joist. An intermediate web 180 connects the front top-hat portion 174 of the joist 172 to its rear flange and channel portions 177,178. Many other types of joist members for use with wooden sheathing panels may be used with the present invention, as those skilled in this art will readily understand.

Figure 16:
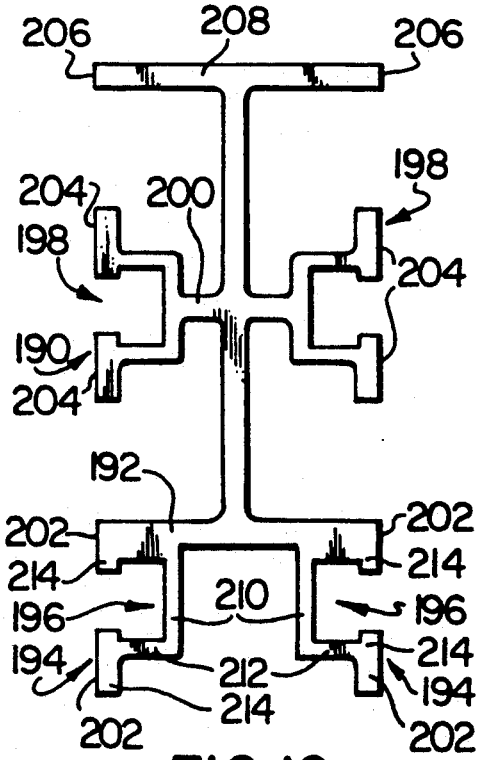
FIG. 16 is a structural member according to a second embodiment of the present invention which provides two pairs of channel-like attachment means.

In FIG. 16 there is shown a second embodiment of a structural member 190 according to the present invention. Again, the construction of the member 190 lends itself to manufacture from aluminum alloy extrusions.

The structural member 190 is similar in construction to the strongback member 10, but further provides, adjacent its rear flange portion 192, a second pair of attachment means 194. Each of the attachment means 194 presents a channel 196 extending the entire longitudinal length of the member 190. The channels 196 are open in substantially the same direction as the first pair of attachment means 198 disposed at the terminal ends of web 200. The second pair of attachment means 194 provide an abutment surface 202 which is substantially coplanar with the abutment surfaces 204 of the first pair of attachment means 198, and further, are substantially coplanar with the side edges 206 of front flange 208 of the member 190.

Each channel 196 of the second pair of attachment means 194 is generally of rectangular cross section, as is the case for the first pair of attachment means 198. The channels 196 are defined by an inner wall portion 210 connected substantially perpendicularly to the lower flange 192 of member 190. A side wall portion 212 extends from the terminal end of the inner wall portion 210 in a direction substantially parallel to flange 192, the free ends of the side wall portion 212 and of the flange 192 each being provided with coplanar flanges 214 defining the abutment surfaces 202 of the second pair of attachment means 194. The coplanar flanges 214 extend inwardly of the channels 196 to thereby provide a substantially T-shaped slot for the attachment means 194.

Figure 17:
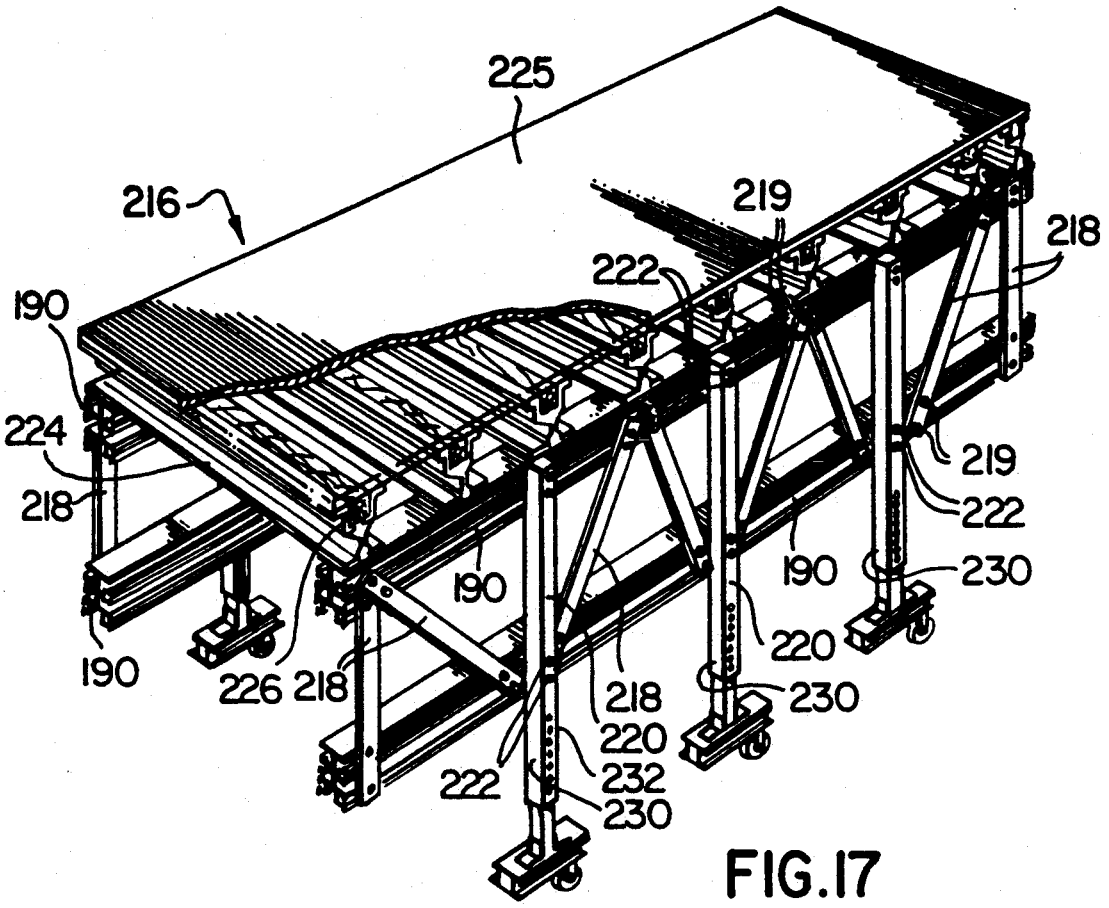
FIG. 17 is a perspective view of a flying form assembly for the pouring of a concrete floor slab, the form employing the structural member according to the second embodiment of the present invention.

As shown in FIG. 17, the structural member 190 is ideally suited to be used as the horizontal beams in a flying form structure, generally designated by reference character 192. The structural members 190 may be arranged to form a pair of substantially parallel and vertically disposed trusses. Each of the trusses comprises an upper and lower structural member 190, which are joined together by a plurality of chords 218. As well, vertical columns 220 are also provided at spaced intervals of the truss and are connected to the top and bottom structural members 190 by means of bolts, nuts and washer assemblies 222 or the like. The chord members which interconnect the upper and lower structural members 190 are affixed thereto by means of bolts, nuts and washer assemblies 219 or other like fastening means.

Each vertical truss of the flying form assembly 192 supports a plurality of transversely disposed joist members 224, which may be of the same type as member 172 illustrated in FIG. 15. An upper deck 225 made of wooden panels, for instance, and for supporting the liquid concrete to be poured, is placed onto the joist members 224 and secured thereto by means of nails, screws or other like fasteners driven into wooden inserts 226 held by the joist members 224.

The structural member 190 is well-suited to be used in the flying formwork assembly 216 since the two pairs of attachment means 196,198 provided by the member 190 allow for many different attachment positions and geometries for the chord members 218 and the vertical columns 220 of the truss. Moreover, two connecting bolts 219 or 222, as the case may be, are employed at each end of the connecting members 218,220 for a more secure assembly. As well, the provision of the two attachment means 194,198 on the structural member 190 allows for the construction of a supporting truss in a flying form assembly 216 without the necessity of resorting to gusset plates for securing the interconnection of the various structural members of the truss, and renders it possible to easily assemble a particular truss structure using standard or prefabricated structural components.

Figure 18:
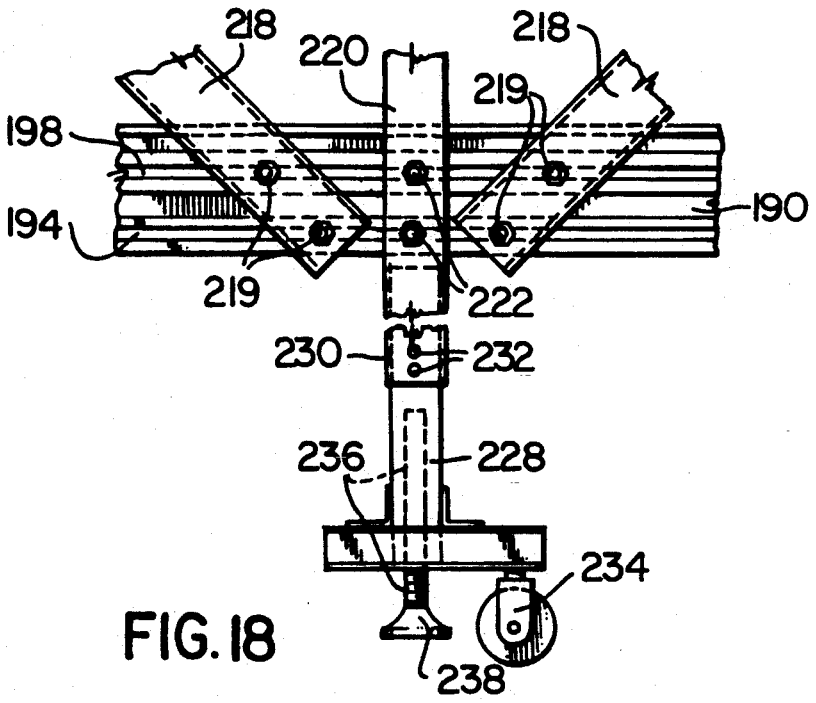
FIG. 18 is a detailed side elevational view of a portion of the flying form of FIG. 17, showing the attachment of the vertical columns and chord members to the structural members, and also showing a telescoping screw-jack and castor assembly for supporting the form.

In FIG. 18, there is shown a detail of the bottom portion of a vertical column 220 of the supporting truss, which is provided with a telescoping support 228 receivable in a hollow terminal portion 230 of member 220. The telescoping support 228 may be held to a desired extension position by means of a hole and pin arrangement 232 well known to those skilled in this art. Any other locking mechanism for the telescoping support of the vertical column 220 may be employed as well.

The telescoping support 228 provides, at its lower extremity, a castor 234 together with a screwjack and foot plate assembly 236. The castors 234 allow the entire flying form to be easily moved into position, whereupon screwjacks 236 may be extended past the contacting surface of the castor wheels to thereby support the formwork assembly solely by means of foot plates 238. When the concrete slab supported by the form has sufficiently cured, the screwjack and foot plate assembly 236 may be retracted to allow the castors 234 to once again contact the floor surface for easy movement of the formwork.

Figure 19:
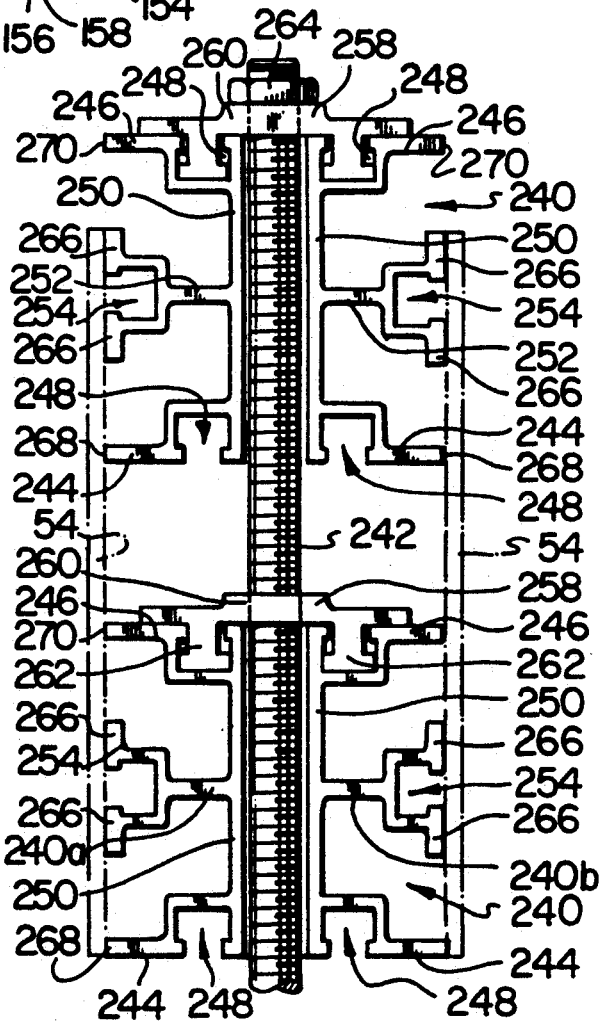
FIG. 19, located on the same sheet of drawings as FIGS. 15 and 16, is a structural member according to a third embodiment of the present invention, wherein the member is provided in two generally E-shaped parts which are placed back to back with a tie rod disposed therebetween.

Turning now to FIG. 19, there is shown a third embodiment of a two-part strongback member 240, having two symmetrical and generally E-shaped elongate beams **240*a* and 240*b*, which may be formed from aluminum extrusions if desired. The two parts of the strongback 240*a*,240*b* are arranged back-to-back in a spaced apart configuration to permit a tie rod 242, or the like, to be disposed therebetween. Each of the parts 240*a* and 240*b* provides front flange portions 244 and rear flange portions 246. These flange portions in turn provide attachment means 248 which present a substantially T-shaped channel extending the entire longitudinal length of each part, the front and rear flange portions 244,246 being connected by means of an intermediate web 250**.

The channels of the attachment means 248 of the two-part members 240 are open in a direction generally outwardly of the transverse webs 252 of each part **240*a*,240*b* of member 240. These transverse webs 252 are centrally attached to web 250 and each has, at its free terminal end thereof, an attachment means in identical form to attachment means 22 of the strongback members 10** previously described.

The two attachment means 248, which are respectively located on each part **240*a*,240*b* on either side of a tie rod 242, together constitute means for receiving a joining member such as a tie connector plate 258. The plate 258 provides an aperture 260 for receiving the tie rod 242, and further provides two substantially T-shaped extensions 262 which are received in slip fit engagement with the respective adjacent channels 248 located on each of the parts 240*a* and 240*b*. FIG. 19 shows a paired configuration for the two-part strongback member 240, but only a single such strongback may be employed if desired and if shored by conventional means known to those skilled in this art. A nut 264 and washer (not shown) may be used to secure the tie rod 242 to the outermost connector plate of the paired assembly of two-part strongback members 240**.

Preferably, the abutment surfaces 266 of the attachment means 254, and the leading side edges 268,270 of front and rear flange portions 244,246 are all made substantially coplanar to provide a secure surface for abutment of a chord 54 (shown in phantom lines in FIG. 19)

or other structural member to be connected to the strongback member 240.

Figure 20:
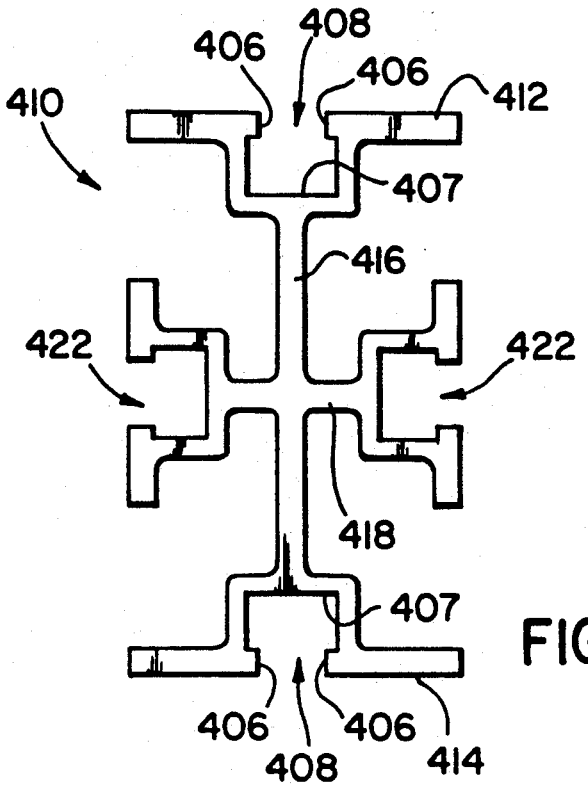
FIG. 20 is a cross-section of a variant of the first embodiment of the strongback member of the present invention shown in FIG. 3, which includes front and rear channel-like attachment means in addition to the pair of attachment means disposed on the transverse web thereof.

FIGS. 20 to 24 show a number of different variants of the embodiments of the structural members already described in detail above. In FIG. 20, there is shown a structural member 410 having a similar construction to structural member 10 of FIG. 3. However, the structural member 410 additionally provides a further pair of attachment means 408 at the front and rear flange portions 412,414 joined together by an intermediate first web 416. The attachment means 408 are of similar construction to attachment means 422 of the transverse web 418 of the member 410 which, in turn, are of a similar construction to attachment means 22 of the strongback member 10 previously described. As shown in FIG. 20, portions 406 of the front and rear flanges 412,414 extend inwardly of the channels 407 to provide a substantially T-shaped slot for retaining the head of a fastening means such as a bolt.

Figure 21:
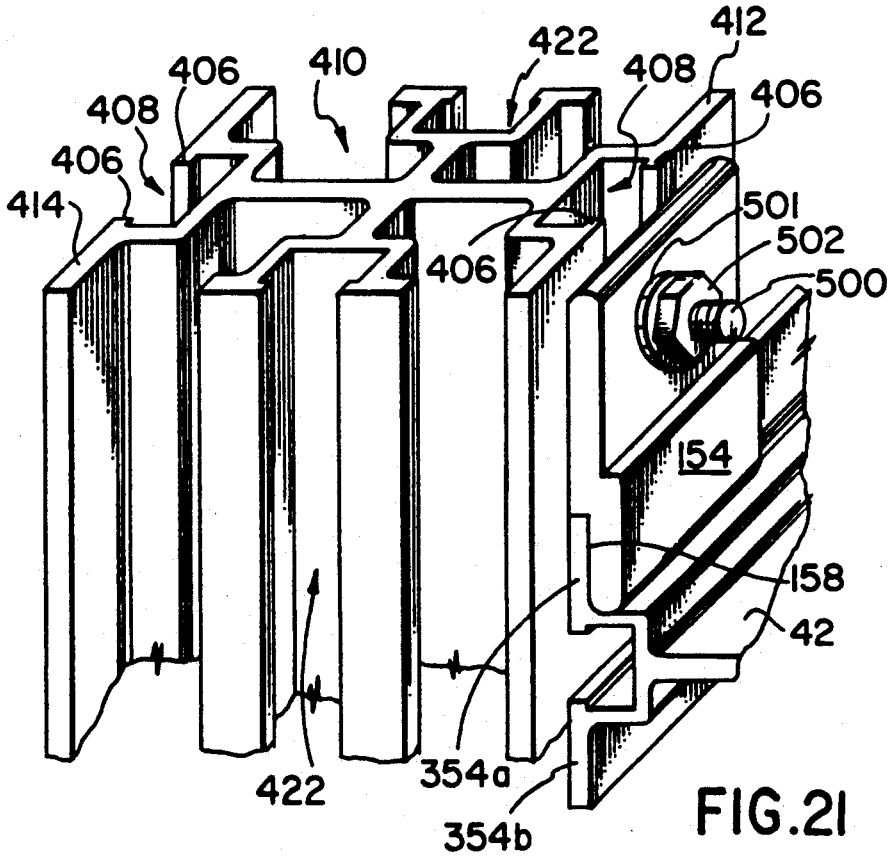
FIG. 21 is a partial perspective view showing the attachment of the strongback member of FIG. 20 to the waler member according to FIG. 4 by means of the clip member of FIG. 10.

FIG. 21 shows how the strongback member 410 may be connected to a waler member 42 by means of clip member 154 disposed in a vertical direction adjacent the front flange portion 412 of member 410. Clip member 154 is affixed to member 410 by means of a bolt 500 whose head (not shown) is slidably received into the channel means 408 at the front flange 412. A washer 501 and nut 502 are used to secure the clip member 154 and urge its surface 158 against the rear abutment surface 354*a* of waler 42. In an analogous manner, another clip member 154 (not shown) may be disposed on the member 410 in order to secure the lower rear abutment surface 354*b* against the flange 412 of the strongback member 410.

Figure 22:
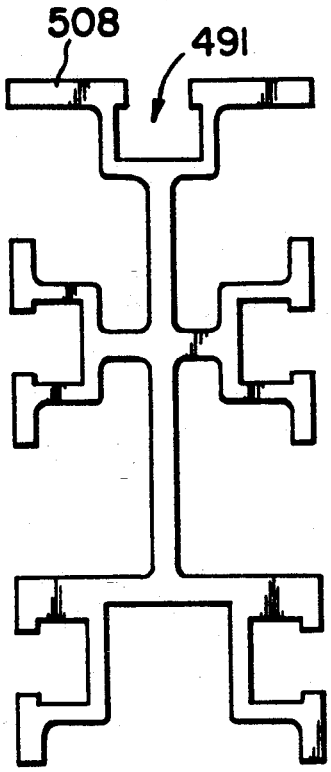
FIG. 22 is a cross-section of a variant of the second embodiment of the strongback member of the invention shown in FIG. 16, which includes a front channel-like attachment means disposed at the front flange portion thereof.

FIG. 22 shows a structural member 490 which is similar in construction to the structural member 190 shown in FIG. 16. The member 490 further provides a channel-like attachment means 491 at its front flange 508. The attachment means 491 of member 490 has a similar configuration to the attachment means of the different embodiments and variants of the present invention previously described. As is the case for structural member 190, the structural member 490 is especially useful as a horizontal beam in the truss of a flying form structure.

Figure 23:
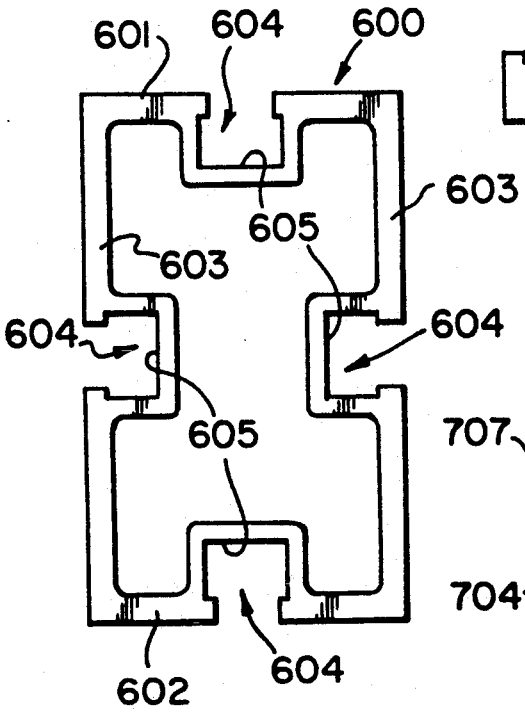
FIGS. 23 and 24 are cross-sectional views of further variants of the strongback members respectively shown in FIGS. 20 and 22, wherein the strongbacks are formed from rectangularly shaped and hollow beam members.
Figure 24:
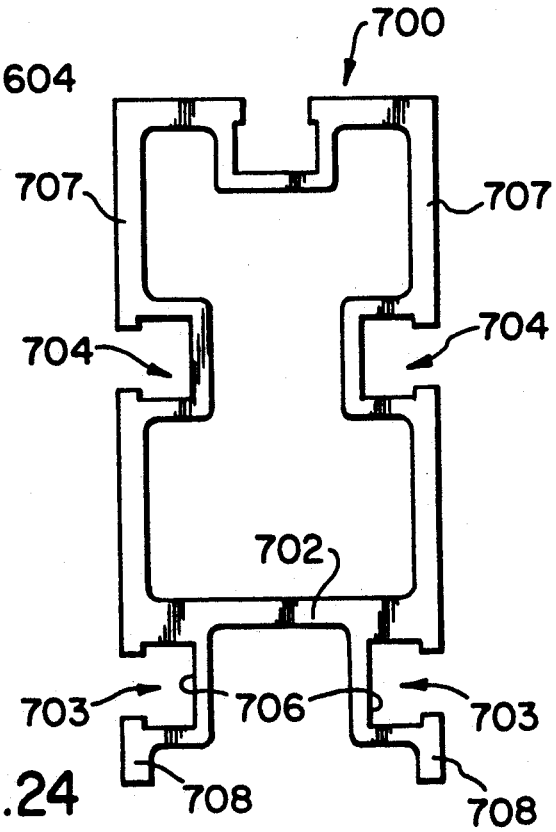

FIGS. 23 and 24 represent structural members 600 and 700 which are variants of the structural members 410 and 490, respectively. Rather than providing a pair of intermediate webs 416 and 418 disposed in a substantially cruciform configuration, the member 600 has a generally rectangular cross-sectional configuration. The member provides front and rear abutment surfaces 601,602 and side abutment surfaces 603, all of which form the sides of the rectangular configuration of the member 600. A plurality of channel-like attachment means 604 are provided by the member, each being respectively disposed at each of the side abutment surfaces 603 and at least at one of the front and rear abutment surfaces 601,602. As with the other structural members previously described, the attachment means each present a channel which extends the entire longitudinal length of the member. In the case of member 600, each of these channels 605 is recessed from the abutment surfaces at which they are disposed and are outwardly open with respect thereto.

In the structural member 700 shown in FIG. 24, the rear abutment surface 702 thereof does not provide a channel-like attachment means. Rather, a pair of attachment means 703 is provided thereon, each of the attachment means 703 presenting a channel 706 which is open in substantially the same direction as the attachment means 704 disposed at each of the side abutment surfaces 707 of the member. The attachment means 703 each provide an abutment surface 708 which is substantially coplanar with the side abutment surfaces 707.

Although the various structural components described above will generally all be amenable to manufacture from aluminum alloy extrusions, other structurally suitable materials and fabricating processes will be apparent to those persons skilled in this art. Furthermore, the present invention has been described hereinabove by way of example only, and those skilled in this art will readily appreciate that numerous modifications of detail may be made to the invention, all of which would come within its spirit and scope.

I claim as my invention:

1. An elongate beam for concrete formwork, the beam comprising:

a flat front flange and a flat rear flange, said flanges being disposed in a spaced apart and substantially parallel configuration, each flange having side edges at terminal ends thereof which extend longitudinally the entire length of said beam;

a first intermediate web connecting said front and rear flanges and having two sides extending longitudinally the entire length of said beam;

a second intermediate web transversely connected to said first web, said first and second webs being disposed in a substantially cruciform configuration;

a pair of attachment means, said attachment means constituting means for attaching said beam to a structural member, each of the attachment means being respectively disposed at terminal ends of said second web, said means each having a substantially T-shaped channel extending the entire longitudinal length of said beam, each of said channels being open in a direction outwardly and substantially transverse of said first web, the attachment means each further having a planar abutment surface extending longitudinally of said beam and being disposed substantially transversely to said front and rear flanges, each channel of each attachment means having a generally rectangular cross-section and being defined by an inner wall portion connected transversely to said terminal end of said second web and by two sidewall portions which respectively extend from said inner wall portion at the terminal ends thereof, free ends of said sidewall portions each having coplanar flanges defining the said abutment surface of the attachment means, said coplanar flanges extending inwardly of the channel to thereby define said substantially T-shaped slots;

a said side edge of the front flange, a said side edge of the rear flange and a said abutment surface respectively located to each side of said first web being substantially coplanar.

2. The structural member according to claim 1, wherein at least one of said front and rear flanges has an attachment means presenting a channel extending the entire longitudinal length of said member, the channel being open in a direction substantially parallel to said first intermediate web.

3. The structural member according to claim 2, wherein portions of said front and rear flanges extend inwardly of the channel to thereby provide a substantially T-shaped slot.

4. The structural member according to claim 2, wherein one of said front and rear flanges having the said attachment means and the other of said front and rear flanges has a further pair of attachment means, each of said attachment means presenting a channel extending the entire longitudinal length of said member, each of said channels being open in substantially the same direction as the attachment means disposed at the terminal ends of the second web, the said further pair of attachment means each having an abutment surface which is substantially coplanar with an abutment surface of said attachment means of said second web.

* * * * *